United States Patent [19]

Kahmann

[11] Patent Number: 4,765,557

[45] Date of Patent: Aug. 23, 1988

[54] CHALK SNAP STRING DEVICE HAVING IMPROVED BRAKE MEANS

[76] Inventor: Paul G. Kahmann, c/o Keson Industries, Inc., 1160 W. Quincy, Naperville, Ill. 60540

[21] Appl. No.: 140,887

[22] Filed: Dec. 30, 1987

Related U.S. Application Data

[63] Continuation of Ser. No. 842,164, Mar. 21, 1986, abandoned.

[51] Int. Cl.[4] ..... B65H 75/48; B44D 3/38

[52] U.S. Cl. ..... 242/107.3; 242/84.8; 33/138; 33/414

[58] Field of Search ..... 242/107, 107.3, 107.6, 242/84.8, 96, 99, 84.53; 33/138, 414

[56] References Cited

U.S. PATENT DOCUMENTS

| | | | |
|---|---|---|---|
| 3,482,798 | 12/1969 | Kawaguchi | 242/107.3 |
| 3,812,588 | 5/1974 | Bennett | 33/138 |
| 3,888,010 | 6/1975 | Hyde et al. | 33/87 |
| 4,121,785 | 10/1978 | Quenot | 242/84.8 |
| 4,153,996 | 5/1979 | Rutty | 33/138 |
| 4,194,703 | 3/1980 | Roe | 242/107.2 |
| 4,205,448 | 6/1980 | Asai | 33/138 |
| 4,449,302 | 5/1984 | Drechsler et al. | 33/138 |
| 4,527,334 | 7/1985 | Jones et al. | 33/138 |
| 4,555,854 | 12/1985 | Kuntze | 33/138 |
| 4,565,011 | 1/1986 | Karger | 33/414 |
| 4,592,148 | 6/1986 | Longenette | 33/414 |

*Primary Examiner*—David Werner

*Attorney, Agent, or Firm*—Wood, Dalton, Phillips, Mason & Rowe

[57] ABSTRACT

An automatic retractable chalk snap string device having an improved brake structure for selectively braking the spring-biased hub on which the chalk string is retractably wound. The brake control includes a brake lever having a manipulating surface adapted to be engaged by a user's finger, such as the user's thumb, in a rocking motion, permitting the user to apply force in both removing the brake pad from the winding hub and to apply the brake pads to the winding hub in concert with a biasing spring similarly acting to urge the brake pads agains the hub. The hub is provided with projecting brake surfaces to be engaged by the brake pads to provide further improved, positive selective braking action. The arrangement of the brake lever is coordinated with the configuration of the housing of the device to permit facilitated one-hand control of the functioning of the device.

7 Claims, 1 Drawing Sheet

FIG. 1
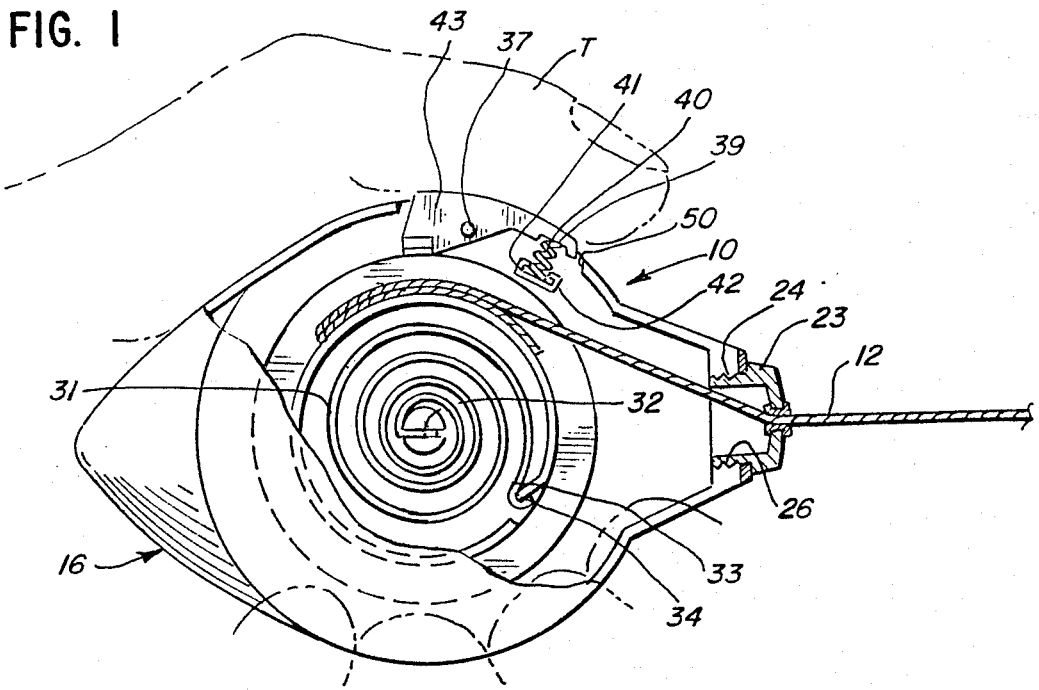
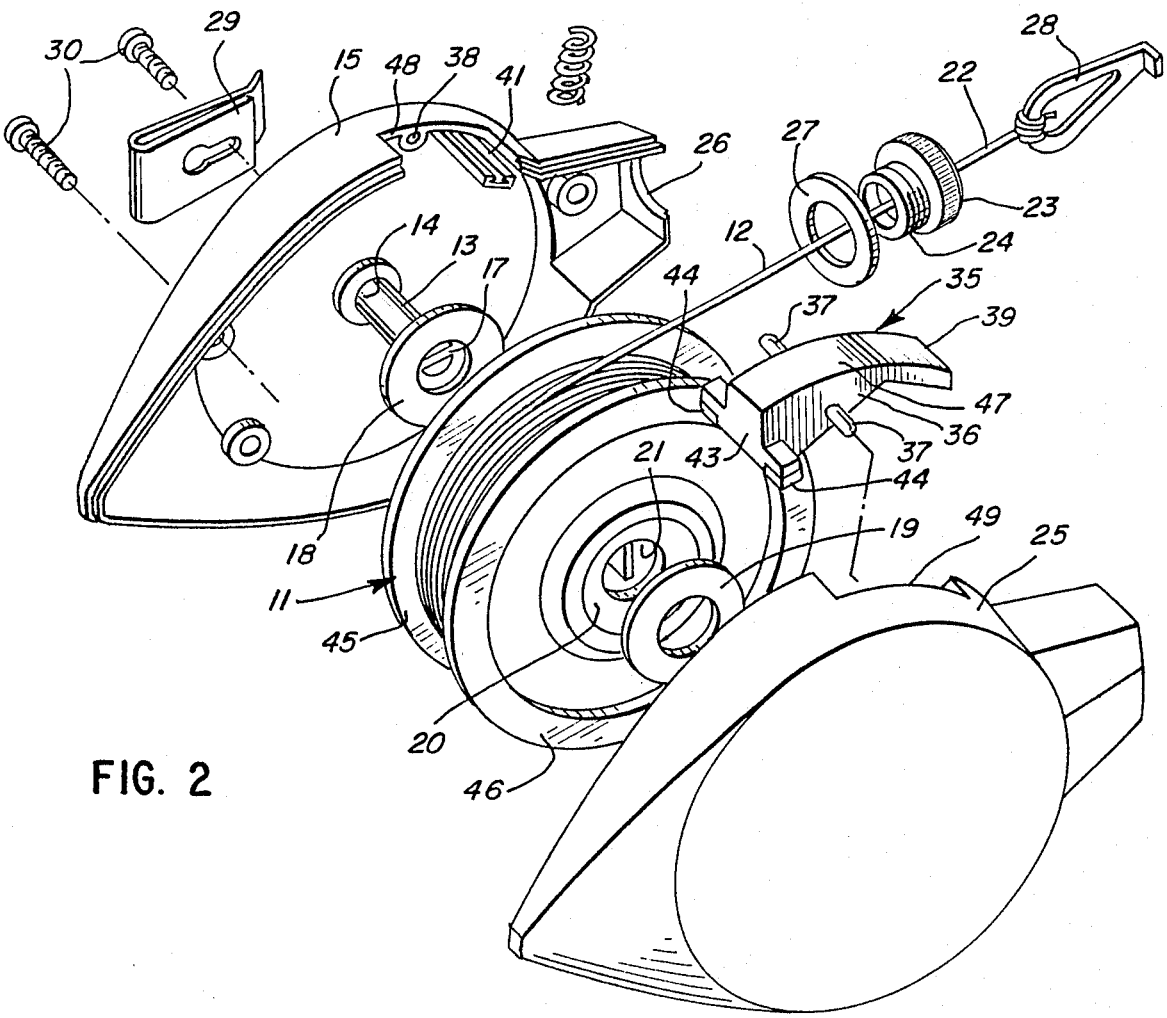
FIG. 2

CHALK SNAP STRING DEVICE HAVING IMPROVED BRAKE MEANS

This is a continuation of application Ser. No. 842,164, filed Mar. 21, 1986 and now abandoned.

TECHNICAL FIELD

This invention relates to chalk snap string devices and in particular to automatic retractable chalk snap string devices.

BACKGROUND ART

In the conventional snap string device, a string is wound on a hub by means of a suitable handle. The string may be drawn out from the hub. The withdrawn string is caused to extend adjacent the surface on which a chalk line is to be marked, and the string is then subsequently pulled outwardly from the surface while the distal end and the end on the hub are fixedly held, whereupon release of the string causes a snapping thereof against the surface, leaving a chalk line on the surface deposited from the chalk with which the string is covered.

DISCLOSURE OF INVENTION

The present invention comprehends an improved chalk snap string device which is automatically retractable and which includes an improved means for braking the hub on which the string is wound with a sufficient force to permit the snapping of the string without undesirable rotation of the hub.

The invention comprehends that the hub be rotatable by means of a biasing spring tending to urge the string into wound relationship about the hub.

The device includes an outer housing having an opening through which the spring is longitudinally translated in the use of the device.

The invention comprehends the provision of an improved brake means carried by the housing and acting against the hub for locking the hub against rotation automatically.

In the illustrated embodiment, the brake means includes a lever which is biased by a spring to urge brake pads carried by the lever against a peripheral braking surface on the hub in effecting the desired locking operation.

In the illustrated embodiment, a midportion of the lever is pivotally mounted to the housing. The spring means comprises a coil spring which is compressed between one end of the lever and a spring retainer retaining the opposite end of the spring in fixed association with the housing.

The other end of the lever is provided with brake pads which are caused to frictionally engage a pair of annular flanges extending coaxially of the hub.

The lever is provided with an outer manipulating means exposed to outwardly of the housing to be engaged by the distal end of a user's finger both forwardly and rearwardly of the lever midportion for urging the brake pads away from the hub flanges by pressure of the tip of the user's finger against the manipulating surface means forwardly of the midportion to act in opposition to the spring means, and urging the brake surface means against the hub by pressure of the ball of the user's finger against the manipulating surface means rearwardly of the midportion of the lever to act in concert with said spring means in selectively locking the hub against rotation by said biasing means in the use of the device.

Thus, the chalk snap string device of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a side elevation of a chalk snap string device embodying the invention, with portions broken away to facilitate illustration of the invention and with the device shown in association with a user's hand for selectively controlling the use thereof; and FIG. 2 is an exploded perspective view illustrating the chalk snap string device.

BEST MODE FOR CARRYING OUT THE INVENTION

In the illustrative embodiment of the invention as disclosed in the drawing, an automatic retractable chalk snap string device generally designated 10 is shown to comprise a hub generally designated 11 about which is wound a chalk string 12. The hub is rotatively journaled on a support rod 13 having one end 14 fixedly secured to a first portion 15 of a bipartite housing generally designated 16. The opposite end of the rod is provided with a cross slot 17. A pair of annular seals 18 and 19 is provided on the rod to be received in suitable recesses 20 in the hub for sealing the journal bore 21 of the hub against entry of chalk thereinto in the use of the device.

The distal end 22 of the chalk string 12 is extended outwardly through a guide structure 23 threadedly secured to the housing 16 by means of a threaded portion 24. Housing portion 15 cooperates with a second housing portion 25 in defining a female threaded portion 26 for receiving the guide device threaded portion 24. A seal 27 is provided for preventing loss of chalk outwardly through the threaded connection.

A suitable clip 28 may be provided on the distal end of the spring, as illustrated in FIG. 2. The clip further serves to prevent retraction of the distal end 22 of the string fully into the housing in the retracted disposition thereof.

A belt clip 29 may be secured to the housing portion 15 by suitable threaded fasteners, such as screws 30.

Hub 11 is biased to draw the string 12 fully thereabout by means of a spiral spring 31. One end 32 of the spring is received in the retainer slot 17 of axle 13 and the other end 33 of the spring is received in a suitable notch 34 in the hub. The spring is arranged to urge the hub in a counterclockwise direction, as seen in FIG. 1, so as to retract the string into the housing. As the string is drawn out from the housing, the spring provides increasing force on the string. Thus, in retracting the string, the string is rapidly retracted from the fully extended disposition and increasingly less force is applied thereto as the string is more and more fully wound on the hub.

The invention comprehends the provision of means for disabling the retraction spring 31, when desired, by braking the hub selectively. In the illustrated embodiment, the braking means comprises a brake lever 35 having a midportion 36 provided with pivot pins 37 pivotably received in pivot bores 38 provided in each of the housing halves 15 and 25.

The lever further defines a forward portion 39. A coil spring 40 is compressed between the underside of forward portion 39 and a channel 41 defining an adjustable retainer for the lower end 42 of the spring. Thus, in the installed arrangement, spring 40 biases the brake lever in a counterclockwise direction, as seen in FIG. 1, on the pivots 37 so as to move a rear portion 43 of the brake lever toward the hub.

As best seen in FIG. 2, a pair of brake pads 44 is provided on the lower side of the rear portion 43 for engagement with a pair of radially projecting annular flanges 45 and 46 at axially opposite sides of the hub. The strength of the spring is preselected so as to cause the brake pads to engage the peripheral surface of the flanges with sufficient force to lock the hub against rotation in all arrangements of the device, including when the string has been fully extended so as to cause the spring 31 to be fully wound.

The outer surface 47 of the brake lever is uniquely configured so as to define a novel manipulatiang surface means, which is exposed outwardly of the housing to be engaged by the distal of the user's finger both forwardly and rearwardly of the brake lever midportion 36. Housing half 15 is provided with an opening 48 which mates with a complementary opening 49 on the housing half 25 so as to define a window 50 through which the manipulating surface is exposed to the user's finger in the normal use of the device, as shown in FIG. 1.

The manipulating surface defines an arcuate surface having a width parallel to the axis of the hub approximately equal to the user's finger and a length sufficient to be engaged by both the tip and ball of the end of the user's finger. In the illustrated embodiment, the finger utilized for manipulating the brake lever comprises the user's thumb T, with the other fingers being disposed in embracing relationship with the underside of the housing so as to provide a simple retention of the chalk string device in the user's hand, with the thumb positioned for accurate rocking control of the brake lever in selectively applying and releasing the brake means.

The provision of the flanges on the hub disposes the braking surface of the hub suitably to be engaged by the brake shoes and with minimized tendency of the chalk within the device to interfere with the desired braking action. The ability of the user to press down on the rear portion of the brake lever so as to apply a force in concert with the force applied by the spring 40 assures a positive retention of the hub in the selected disposition, such as when the string is extended so as to cause the retracting spring 31 to provide maximum retraction force. As shown in FIG. 1, the manipulating surface 45 is substantially flush with the outer surface of the housing 16 in the normal disposition thereof.

Thus, the chalk snap string device of the present invention is extremely simple and economical and provides an improved novel braking control for the spring-biased string winding hub, which provides improved usefulness of the device over the devices of the prior art. The device is extremely simple and economical of construction.

The foregoing disclosure of specific embodiments is illustrative of the broad inventive concepts comprehended by the invention.

I claim:

1. In a chalk snap string device having a winding hub, a chalk string wound about the hub, an outer housing with a front and rear to be surroundingly grasped by the hand of a user and defining a string-passing opening at the front of the housing, means for rotatably mounting the hub within the housing with a distal end of the chalk string extending outwardly from the hub through said housing opening, and means for biasing the hub rotatively to wind the chalk string and thereby move the string inwardly through said opening in substantially a straight path from front to rear on the housing towards the palm of a hand surroundingly grasping the housing and about the hub, the improvement comprising:

a brake lever having a brake surface and an exposed manipulating surface extending generally parallel to the straight path;

means pivotally mounting the brake lever to the outer housing for rotation about an axis and in a position to be engaged by a user's finger situated in overlying relationship with the exposed manipulating surface with the housing surroundingly grasped by a user;

spring means for biasing the brake lever for rotation in a first direction about said axis to thereby urge the brake surface toward said hub;

first manipulating surface means on said lever exposed to outwardly of said housing and forwardly of said axis to be engaged and depressed by the distal end of the user's finger without any portion of the user's hand surroundingly grasping the housing obstructing the string-passing opening to pivot the brake lever against the bias of the spring means and urge said brake surface away from the hub; and second manipulating surface means on said lever exposed to outwardly of said housing and rearwardly of said axis to be engaged and depressed by the ball of the user's finger to pivot the brake lever and urge the brake surface means against the hub in concert with a bias from said spring means in selectively locking the hub against rotation of said hub biasing means in use of the device.

2. The chalk snap string device of claim 1 wherein said spring means comprises a coil spring and a channel member slidably receiving one end of the coil spring and defining means for adjustably positioning the coil spring on said housing for compressible engagement by said brake lever.

3. The chalk snap string device of claim 1 wherein said hub defines a pair of coaxial annular braking surfaces and said brake surface means comprises a pair of coaxially spaced brake pads carried by said brake lever to be forcibly concurrently urged against said hub braking surfaces by the ball of the user's finger in use of the device.

4. The chalk snap string device of claim 1 wherein said housing defines an arcuate portion provided with a through opening and said first and second manipulating surface means define an arcuate surface having a width parallel to the axis of the hub approximately equal to a user's finger and projecting outwardly through said through opening to dispose said arcuate surface of the manipulating surface means substantially flush with said arcuate portion of the housing.

5. In a chalk snap string device having a hub, a chalk string wound about the hub, an outer housing to be surroundingly grasped by a user and defining a string-passing opening at a forward portion of the housing, means for rotatably mounting the hub within the housing with a distal end of the chalk string extending outwardly from the hub through said housing opening, and means for biasing the hub rotatively to wind the chalk string and thereby move the string inwardly through said opening from front to rear on the housing toward the palm of a hand surroundingly grasping the housing and about the hub, the improvement comprising:

a pair of coaxially spaced annular flanges on the hub;

a brake lever;

means mounting a midportion of the brake lever rotatively to the housing about an axis;

spring means carried by the housing and engaging the brake lever for biasing the brake lever rotatively in a first direction about said axis;

a pair of axially spaced brake pads carried by the lever rearwardly of said axis to be urged forcibly by said spring means against said hub flanges upon said brake lever being rotated in said first direction about said axis;

first manipulating surface means on said lever exposed to outwardly of said housing and forwardly of said axis to be engaged and depressed by the distal end of a user's finger without any portion of the user's hand surroundingly grasping the housing obstructing the string-passing opening to thereby pivot the brake lever oppositely to said first direction against the bias of the spring means and urge said brake pads away from the hub flanges; and second manipulating surface means on said brake lever exposed to outwardly of said housing and rearwardly of said axis to be engaged and depressed by the ball of the user's finger and to act in concert with said spring means in selectively locking the hub against rotation by said hub biasing means in use of the device.

6. The chalk snap string device of claim 5 wherein said spring means comprises a coil spring and a channel member slidably receiving one end of the coil spring and defining means for adjustably positioning the coil spring on said housing for engagement by said brake lever.

7. The chalk snap string device of claim 5 wherein said housing defines an arcuate portion provided with a through opening and said first and second manipulating surface means define an arcuate surface having a width parallel to the axis of the hub approximately equal to a user's finger to dispose said arcuate surface of the manipulating surface substantially flush with said arcuate portion of the housing.

* * * * *